US005392824A

United States Patent [19]

Rabinovich

[11] Patent Number: 5,392,824

[45] Date of Patent: Feb. 28, 1995

[54] VAPOR RECOVERY NOZZLE WITH AUTOMATIC SHUT-OFF SYSTEM

[76] Inventor: Joshua E. Rabinovich, 15 Voss Ter., Newton, Mass. 02159

[21] Appl. No.: 208,851

[22] Filed: Mar. 11, 1994

Related U.S. Application Data

[62] Division of Ser. No. 893,335, Jun. 3, 1992, Pat. No. 5,297,594.

[51] Int. Cl.[6] ..... B65B 31/00

[52] U.S. Cl. ..... 141/59; 141/44; 141/206; 141/227; 141/392

[58] Field of Search ..... 141/59, 392, 206-229, 141/44-46

[56] References Cited

U.S. PATENT DOCUMENTS

| | | | |
|---|---|---|---|
| 3,016,928 | 1/1962 | Brandt . | |
| 3,323,560 | 6/1967 | Ehlers . | |
| 3,826,291 | 7/1974 | Stellens . | |
| 3,835,899 | 9/1974 | Holder, Jr. . | |
| 3,845,792 | 11/1974 | Johnson . | |
| 3,850,208 | 11/1974 | Hamilton . | |
| 3,929,175 | 12/1975 | Coone . | |
| 3,974,865 | 8/1976 | Fenton et al. . | |
| 4,068,687 | 1/1978 | Long . | |
| 4,199,012 | 4/1980 | Lasater . | |
| 4,202,385 | 5/1980 | Voelz et al. . | |
| 4,429,725 | 2/1984 | Walker et al. | 141/59 |
| 4,429,752 | 2/1984 | Walker et al. . | |
| 4,505,308 | 3/1985 | Walker et al. | 141/59 |
| 5,035,271 | 7/1991 | Carmack et al. . | |
| 5,150,742 | 9/1992 | Motohashi et al. . | |
| 5,174,346 | 12/1992 | Healy . | |
| 5,199,471 | 4/1993 | Hartman et al. | 141/59 X |
| 5,213,142 | 5/1993 | Koch et al. | 141/59 |
| 5,217,051 | 6/1993 | Simpson et al. . | |
| 5,244,018 | 9/1993 | Hasselmann | 141/59 |
| 5,273,087 | 12/1993 | Koch et al. | 141/59 X |
| 5,289,856 | 3/1994 | Strock et al. | 141/59 |
| 5,297,594 | 3/1994 | Rabinovich | 141/59 |

FOREIGN PATENT DOCUMENTS

| | | |
|---|---|---|
| 155186 | 9/1985 | European Pat. Off. . |
| 3916691 | 11/1990 | Germany . |

*Primary Examiner*—Ernest G. Cusick

*Attorney, Agent, or Firm*—James Creighton Wray

[57] ABSTRACT

The present invention relates to a vapor recovery nozzle with a turbine located in the nozzle. The turbine is driven by the flow of fuel. The turbine rotates an impeller located in the nozzle which draws away the vapor during pumping operations. The nozzle further has a hydraulic system for automatically shutting off the nozzle when fluid is displaced in an accumulator cylinder.

7 Claims, 5 Drawing Sheets

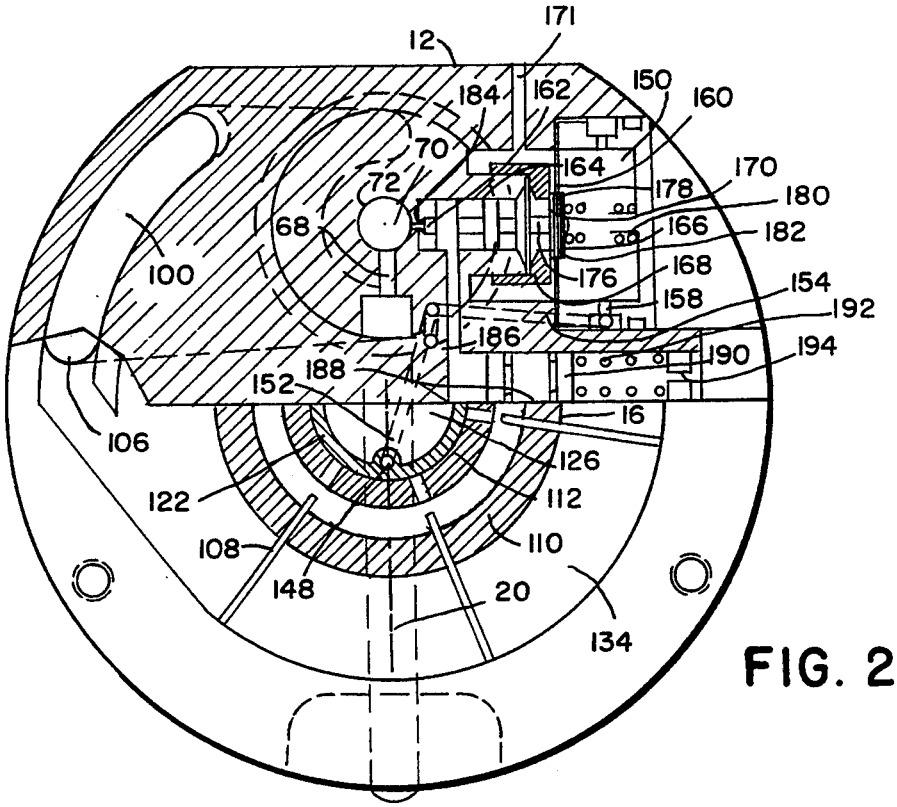
FIG. 2
FIG. 7
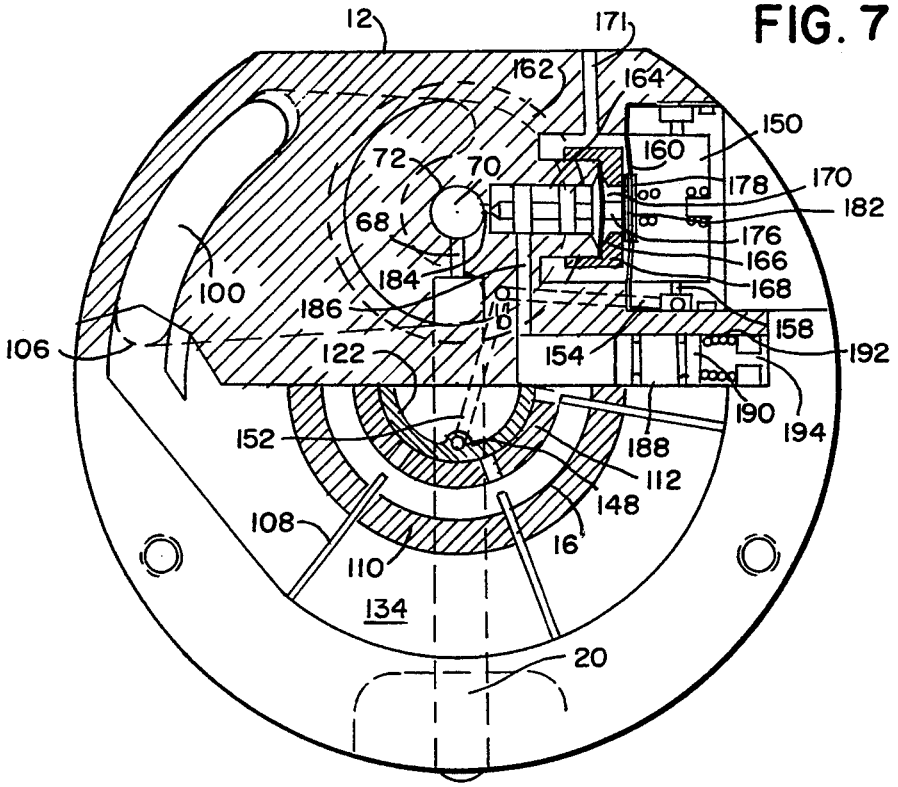

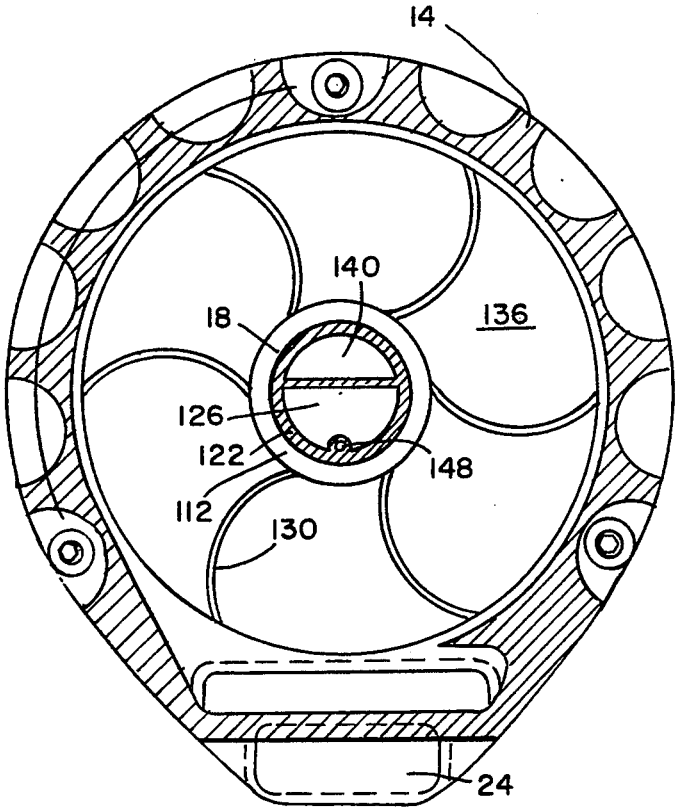
FIG. 3
FIG. 5
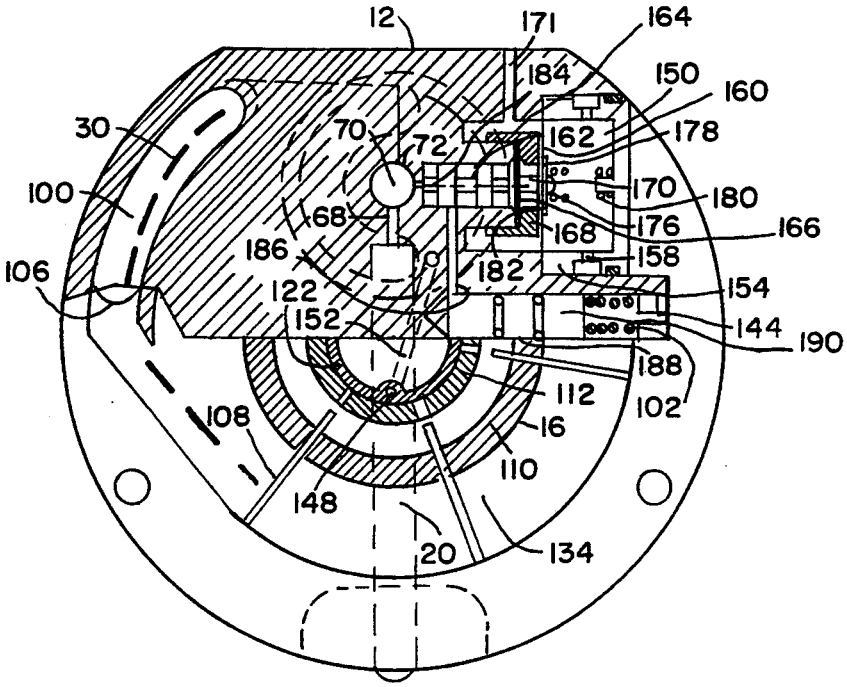

VAPOR RECOVERY NOZZLE WITH AUTOMATIC SHUT-OFF SYSTEM

This application is a division of application Ser. No. 07/893,335, filed Jun. 3, 1992, now U.S. Pat. No. 5,297,594.

BACKGROUND OF THE INVENTION

1. Field of the Invention

This invention relates to a new and improved means and method of recovering fuel vapor in a fuel dispensing nozzle.

2. Background

Ever since the harmful environmental effects of gasoline vapor have been known, devices have been developed to reduce fuel vapors escaping into the atmosphere. A great amount of fuel vapors are released into the atmosphere when gasoline is pumped into an automobile from an underground storage tank at a service station. Such vapors escape into the atmosphere as gasoline is discharged from the spout of the nozzle. On a world-wide scale, millions of pounds of hazardous fuel vapors escape into the atmosphere each year from this single source. The danger of these pollutants is considered serious. Environmental Protection Agency inspectors levy large fines to service station owners who do not have or do not properly maintain vapor recovery systems.

Vapor recovery systems were first introduced in 1974. The systems are intended to recover escaping fuel vapors comprising hydrocarbons and other volatile organic compounds. While improvements over the years has been significant, excessive equipment malfunctions and user dissatisfaction persist. In particular, the present problems associated with vapor recovery systems include difficulty in handling the systems, loss in effectiveness from cuts in the rubber or plastic bellow used to cover the spout of the nozzle and filler neck of the automobile gas tank, and frequent and costly maintenance.

Presently, the two major vapor recovery systems in use are the balanced system and the vacuum assist system. The balanced system is more popular because it is less expensive and more easily maintained by the automobile service station owner. However, in the balanced system it is more difficult for the average user to handle the nozzle to maintain the proper seal between the nozzle and the filler neck.

The balanced system comprises a bellow having crimped edges which essentially extends from a fender guard the length of the nozzle spout. The combination of the pleats of the bellow and a spring-contained therein permit it to compress as the spout is inserted into the filler neck of the automobile tank. The substantially cone-shaped bellow engages and encapsulates the automobile tank filler neck forming a seal to prevent vapor from escaping during pumping. The system uses the positive pressure generated in the automobile fuel tank by the incoming fuel to force the vapor back toward the nozzle where the vapor is returned to the service station storage tank.

Besides the cuts and kinks common to systems using bellows, the balanced system is also ineffective. Motorists do not take the necessary time to make certain that the bellow forms a proper seal over the mouth of the filler neck. Some do not understand the purpose of the bellow, while others cannot position the bellow properly. The rubber or hard plastic bellow is highly resilient for durability reasons which resist the motorist's attempts to keep the spout in the filler neck. Motorists also become tired from holding the nozzle tightly against the filler neck. Often, they relax, which results in premature shut-off due to the loss of the proper seal.

The vacuum assist system uses a vacuum generating device located in the dispenser or storage tank which aspirates vapor in the automobile fuel tank. Sometimes a bellow is also secured to the nozzle, but it is not as essential as in the balance system. The vacuum assist system relies primarily on the vacuum to suck the vapor back through the nozzle. One of such arrangements is described in U.S. Pat. No. 3,826,291 which employs a positive displacement vacuum pump, installed in a dispenser area. The pump's initial high cost and the inherent high wear and maintenance cost make it an unattractive choice for service station owners.

If the vacuum assist system is used in conjunction with bellows, the bellows have the same problems mentioned above. In addition, the vacuum assist system has some of its own problems. For example, when the vacuum generating mechanism for several pumps is located in a common storage tank, the number of pumps in use has an impact on the amount of suction generated. If one pump is in use, the vacuum may be too strong which results in the recirculation of fuel or suction of additional air which results in vapor growth. If the fuel is recirculated, the motorist may be charged for gasoline already dispensed and registered on the totalizer.

On the other hand, if all the station pumps are used at the same time, there may be too little suction. This allows too much of the vapor to escape into the atmosphere making the system ineffective. Additionally, suction may be reduced to unacceptable levels if the flexible hose is too long.

Finally, overall maintenance of the vacuum assist system is very expensive. Repairs in a pump or storage tank causes serious delays and substantial financial hardships. The cost of installation is also significant.

SUMMARY OF THE INVENTION

The principle object of the present invention is to provide a fuel vapor recovery nozzle which recovers fuel vapors emitted when the fuel is dispensed from a storage tank through a nozzle.

Another object of the present invention is to provide a vapor recovery nozzle which is lightweight and simple to use.

It is still a further object of the present invention to provide a vapor recovery nozzle which is simple and inexpensive to manufacture which does not require costly maintenance or repairs.

One more object of the present invention is to provide a fuel vapor recovery nozzle which does not have the limitations of the balanced system or vacuum assist system, is easy to maintain and use, and overall is more efficient in use.

A further object of the present invention is to provide a fuel vapor recovery nozzle which has advantages over a controversial vacuum assist system. In the present invention each nozzle is designed to provide a constant level of vacuum assist which is independent of a central vacuum source and consequently independent of activities at other pumps connected to the same storage unit.

One more object of the present invention is to provide an efficient means for controlling vapor emission at a gas tank which is safe, efficient, and not dependent on the positioning of the dispenser within the vehicle for its efficiency.

Another object of the present invention is to provide a vacuum assist system for removing vapors in which the means for creating suction is located proximate to the dispensing mechanism thereby eliminating the need for a long connection to a suction source, and the need for a greater power to generate suction.

It is a still further object of the present invention to provide a vapor recovery nozzle which maintains a desirable and stable vacuum level at the spout end.

A still further object of the present invention is to provide a vapor recovery system that is not dependent on properly fitting the unit in the gas tank.

To accomplish these and other objects, the present invention comprises a vapor recovery nozzle having a body with a vapor conduit means for passage of vapor, a fuel conduit means for passage of fuel, and a vapor suction means activated by the flow of fuel in the fuel conduit for drawing vapor into the vapor conduit.

These and other objects and features of the present invention will be better understood and appreciated from the following detailed description of one basic embodiment thereof, selected for the purpose of illustration and shown in accompanying drawings, in which:

BRIEF DESCRIPTION OF THE DRAWINGS

FIG. 2 is a cross-sectional view taken along the lines 2—2 of FIG. 1;

FIG. 3 is a cross-sectional view taken along the lines 3—3 of FIG. 1;

FIG. 5 is a cross-sectional view taken along the lines 5—5 of FIG. 4;

FIG. 7 is a cross-sectional view taken along the lines 7—7 of FIG. 6.

DETAILED DESCRIPTION

Figure 1:
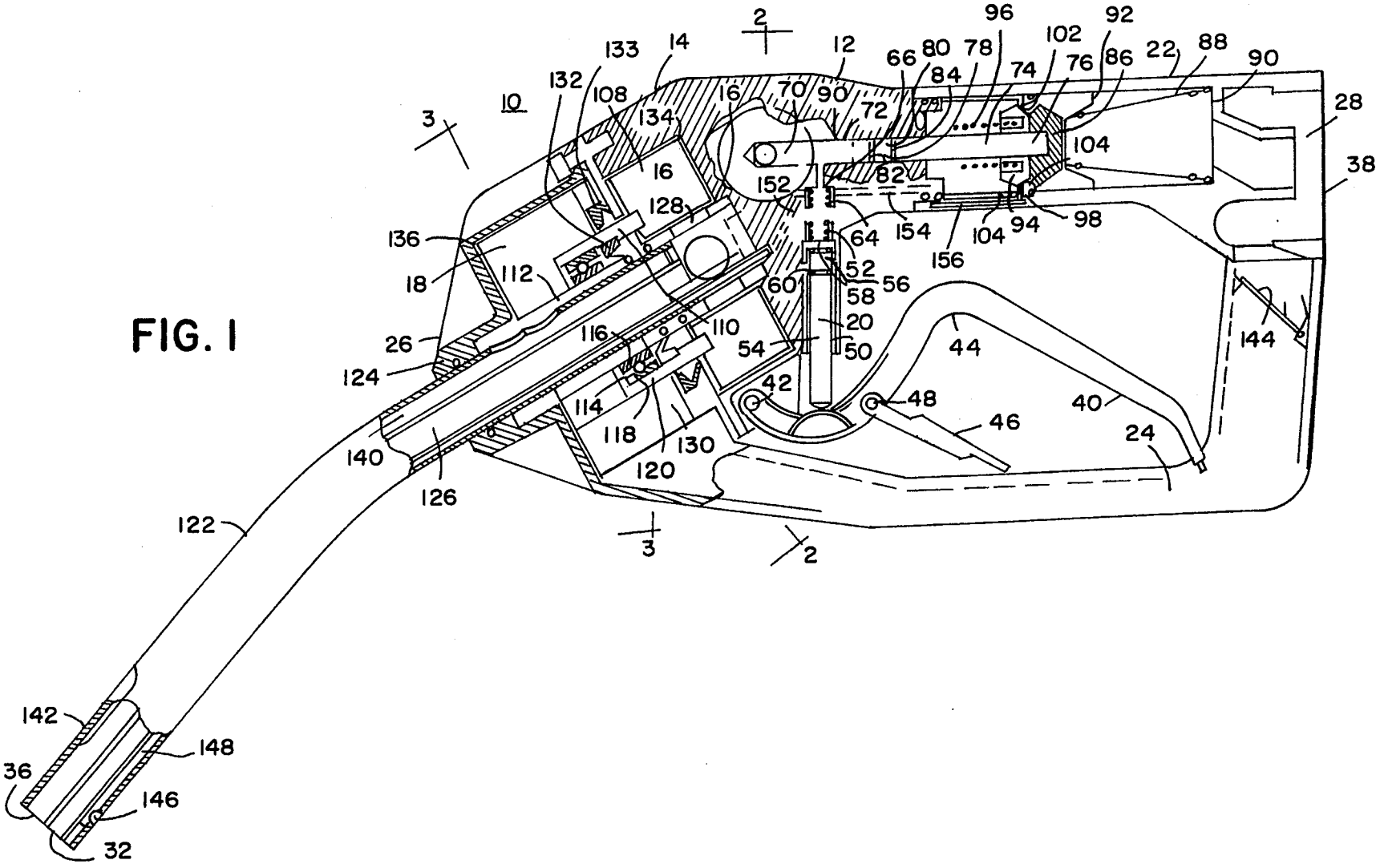
FIG. 1 is a longitudinal cross-sectional view showing the vapor recovery nozzle of the present invention in an off mode.

FIGS. 1-7 illustrate a preferred embodiment of the invention intended for recovering fuel vapor during dispensing at various stages of function. The nozzle 10 is intended to replace the vapor recovery nozzle conventionally used in automobile service stations. In the standard arrangement, in which the present invention 10 may be used, the nozzle is connected to a coaxial flexible hose (not shown) of perhaps 10-15 feet in length, which in turn is connected to the service station pump. An underground storage tank contains the fuel which is delivered through the pump hose and nozzle 10 to the tank of the automobile.

The nozzle 10 consists primarily of a shell or casing 12. This shell 12 includes a housing section 14 at its forward end for the turbine 16 and impeller 18, as well as a portion of the trigger plunger 20. The other or rear end of the shell 12 is integrally connected with a hand grip portion 22 and a rear end of the vapor conduit 24. The vapor conduit 24 extends downwardly from the rear end of the shell or casing 12 and forwardly to the forward end 26 of the housing section 14. The bottom portion of the vapor conduit 24 forms a guard for the trigger plunger 20.

Figure 4:
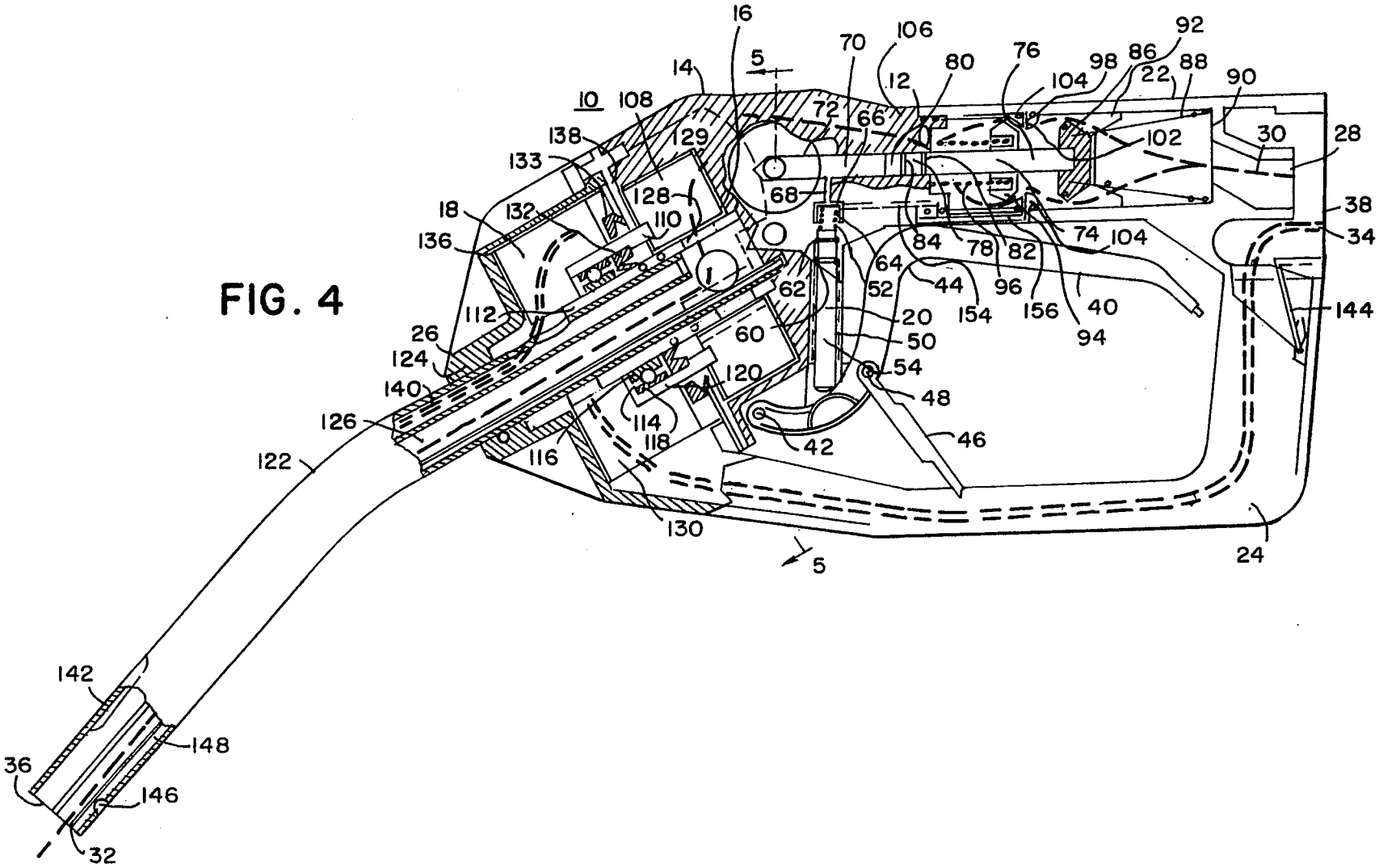
FIG. 4 is a longitudinal cross-sectional view showing the vapor recovery nozzle in an on mode.
Figure 6:
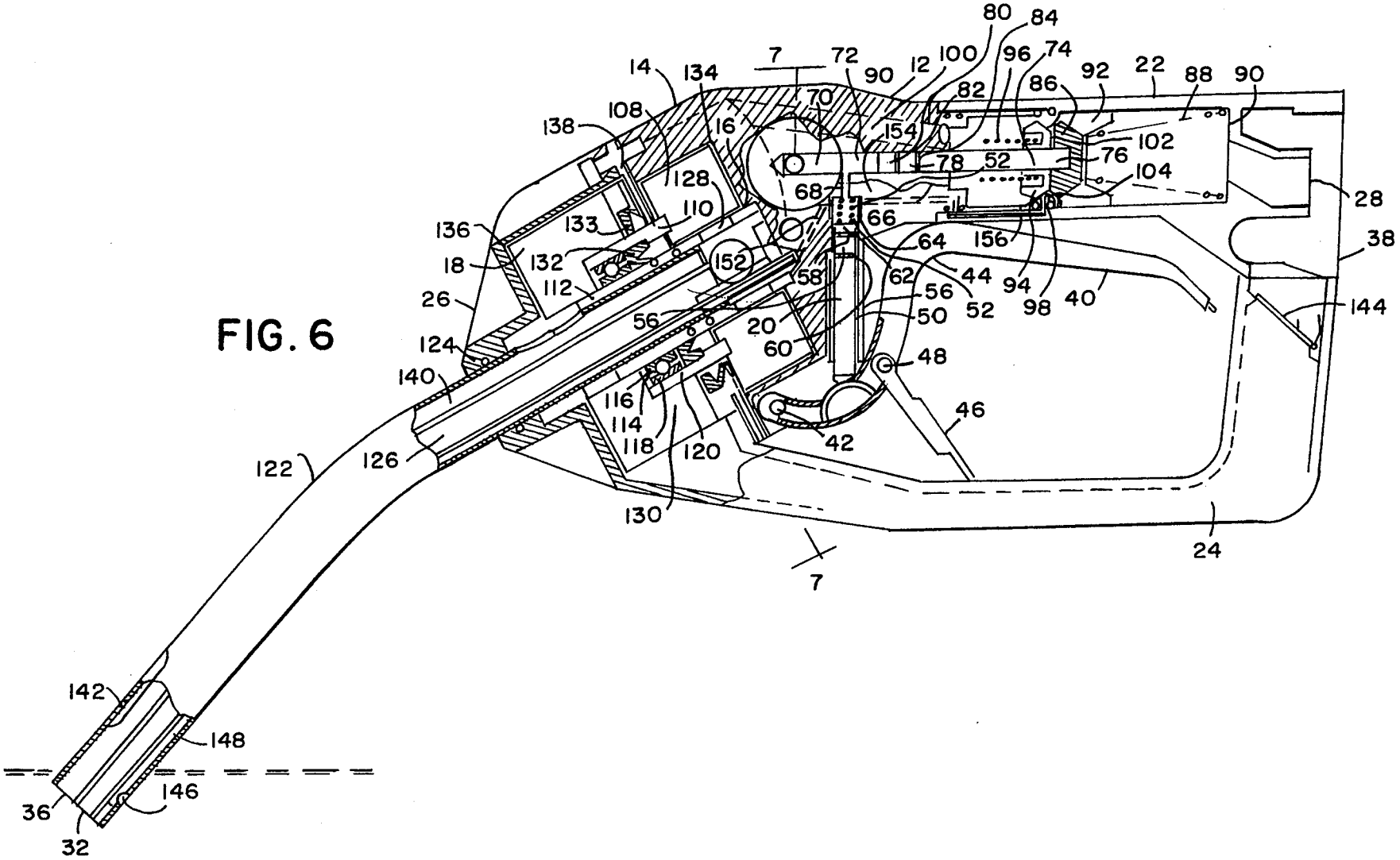
FIG. 6 is a longitudinal cross-sectional view showing the vapor recovery nozzle in an automatic shut off mode.

The system is intended to permit dispensing of fuel from a storage tank while simultaneously recovering fuel vapors from the vehicle tank. The fuel delivered from a coaxial fuel pump hose (not shown) enters the nozzle 10 at opening 28 from the axial channel of the coaxial hose and follows a path generally shown by the dotted line 30, as shown in FIGS. 4 and 5, through various components hereafter described to discharge from the nozzle at forward exit end 32.

A path for the vapor being sucked from the automobile fuel tank to the storage tank is illustrated by the double dotted lines 34 from the point of entrance of the vapor at the forward end 142 to the rear exit end 38 which is connected to the outer channel of the coaxial hose.

The trigger plunger 20 is moved vertically by a finger lever 40 having a hinge 42 with the lever 40 appropriately shaped with a curve portion 44 intermediate its ends to permit the operator to grasp the curve portion 44 with his fingers while holding the shell or casing 12 in the palm of his hand. The finger lever 40 may have attached to it a conventional lock mechanism 46 hinged at one end 48. Pivotal movement of the finger lever 40 causes reciprocal movement of the trigger plunger 20.

Even in its uppermost position, the trigger plunger 20 does not completely fill the plunger cylinder 50. Above the trigger plunger 20, a reservoir 52 is formed containing hydraulic fluid, usually brake fluid. The trigger plunger 20 of the preferred embodiment comprises three sections 54, 56, and 58, of similar diameter separated by channels in which O-rings 60 and 62 are secured. The O-rings 60 and 62 form a seal against leakage of the hydraulic fluid. Also in the reservoir portion 52 of the plunger cylinder 50 is a spring 64 tensioned against the face of the top section 58 of the trigger plunger 20. The other side of the spring 64 abuts a collar 66 of the plunger cylinder 50.

The hydraulic fluid in the plunger cylinder 50 is connected by a passage 68 to a second reservoir 70 formed in a main cylinder 72, an end of which is longitudinally located in the shell 12, and an end of a popper plunger 74. The poppet plunger 74 comprises an arrangement having three sections, 76, 78, and 80 separated by O-rings 82 and 84 which is similar to the trigger plunger arrangement 28. The poppet plunger 74 engages the main popper body 86 against the tension of helical spring 88. The other end of the helical spring 88 engages at its other end an annular flange 90 within the hand grip section 20. The main poppet body 86 is provided with a flange 92, found in the preferred embodiment, radially arranged to receive the forward end of the spring 88 while also shaped to permit fuel to pass therethrough.

As shown in FIG. 4, after passing through the annular flange 90, the fuel continues through an opening formed between a venturi body 98 and a check valve 94, tensioned by a spring 96 against the venturi body 98, and into an elongated passage 100. The venturi body 98 comprises a venturi passage 102 formed between venturi flanges 104 which are secured to the shell or casing 12 along the hand grip section 20. The flanges 104 are shaped to receive the check valve 94 when the nozzle 10 is not in operation, as shown in FIG. 1.

The fluid in the passage 100 is pumped through a constricted inlet passage or fuel jet nozzle 106. The fluid moving through the inlet passage 106 engages a vane 108 of the turbine 16. The vane 108 is supported on and rotatable with the turbine sleeve 110 which in turn is coaxial with one end of a main sleeve 112. The turbine 16 is supported for free rotation on the main sleeve 112 by bearing assembly 114 which has one race 116 secured to the main sleeve 112 and the other race 118 secured to an inner wall of a sleeve portion 120 extending from the turbine sleeve 110.

The spout 122 is suitably secured intermediate its end in the shell 12 by an annular sleeve 124 projecting forwardly from the housing section 14. The spout 122 contains several elongated passages extending from one end to the other. These passages include a fuel delivery passage 126 which is connected for the flow of fluid through an opening 128 at the rear end of the sleeve 112.

The sleeve portion 120 also supports a plurality of impeller vanes 130 which form a portion of the impeller 18. These impeller vanes 130 extend arcuately outward from the rotatable sleeve portion 120. The impeller vanes 130 support annular V-shaped seals 132 and 133 which seal and divide the interior of the housing section 14 into a turbine chamber 134 and an impeller chamber 136. The annular V-shaped seal 133 engages a dividing flange 138 which extends inwardly from the inner surface of the shell 12.

Rotation of the turbine 16 with the introduction of fuel through the turbine 16 into the spout 122 simultaneously rotates the impeller 18. This rotation of the impeller 18 causes a reduction in pressure in vapor passage 140 and an increase in pressure along the periphery of chamber 136. This permits suction at the vapor intake 142 in the spout, causing vapor to move inwardly from end 142 of the spout as shown in the double dotted lines 34. The vapor moves as illustrated by the dotted double lines 34 into the impeller chamber 136, and then through the vapor conduit 24 rearwardly past the vapor check valve 144 and into the outer channel of the coaxial flexible conduit forming the hose (not shown).

The mechanism for stopping the flow of fluid is actuated when the fluid in the tank reaches the forward exit end 32 of the spout 122 and covers the opening 146 of the tank sensing line passage 148 in the spout 122. The sensing line passage 148 extends the length of the spout 122 and is in fluid communication with venturi passage 102 and sensing diaphragm chamber 150 through a network of passages including 152, 154, 156, and 158.

Along one edge of the sensing diaphragm chamber 150 is the sensing diaphragm 160. The diaphragm 160 is orthogonally related to a needle valve 162 which in turn is disposed in a needle valve cylinder 164. In the preferred embodiment, a second diaphragm 166 is secured over the rear end of the needle valve cylinder 164 by a needle valve cavity cap 168. The second diaphragm 166 prevents the hydraulic fluid in the needle valve cylinder 164 from entering a chamber 170 formed between the second diaphragm 166 and the sensing diaphragm 160. Chamber 170 is continually maintained at atmospheric pressure by a vent 171 which passes through the shell 15 to the outside atmosphere. Furthermore, the second diaphragm 166 allows for low friction movement of the needle valve 162 within the needle valve cylinder 164. The diaphragms 160 and 166 are connected to one another by a rod 176 within the chamber 170 such that movement by the sensing diaphragm 160 is imparted on the second diaphragm 166 and the needle valve 162. This arrangement helps reduce the friction in the automatic shut-off operation of the nozzle 10 and reduce the necessary size of the sensing diaphragm 160.

The needle valve cavity cap 168 further engages washers 178 and 182 secured to the sensing diaphragm 160 to facilitate a seal between chambers 150 and 170. A needle valve return spring 180 is tensioned against washer 182 on the sensing diaphragm chamber 150 side of the sensing diaphragm 160. The spring 180 keeps the needle valve 162 in engagement with the opening of a channel 184 when the automatic shut-off of the nozzle 10 is at rest.

The needle valve cylinder 164 is in fluid communication with the second reservoir 70 of the main cylinder 72 through channel 184. In the rest position, the spring 180 forces the needle valve 162 against channel 184 preventing hydraulic fluid from passing into the needle valve cylinder 164.

A passage 186 extends between the needle valve cylinder 164 and an accumulator cylinder 188. The accumulator cylinder 188 has a three-section plunger 190 similar to the other plunger arrangements. An accumulator spring 192 tensions the plunger 190 to the left. When a force is exerted against the spring 192, the pressure on the right side of the plunger 190 will not increase because there is an accumulator vent 194 opening to the outside.

There is always hydraulic fluid in the needle valve cylinder 164, passage 186, and accumulator cylinder 188. However, during operation of the automatic shut-off, the amount of fluid in the needle valve cylinder 164 and accumulator cylinder 188 will change.

OPERATION OF THE VAPOR RECOVERY NOZZLE

The operation of the nozzle can best be understood by first considering the status of the nozzle components in an off position as illustrated in FIGS. 1–2 and then consider the status of the various components in an on position as illustrated in FIGS. 4–5.

In its off position, as illustrated in FIG. 1, the finger lever 40 is down thus permitting the trigger plunger 20 to move to a down position. When the trigger plunger 20 is in a down position, the hydraulic fluid fills the upper end of the plunger cylinder 50. In this position the poppet plunger 74 is moved forwardly or to the left as viewed in FIG. 1. This permits the main poppet body 86 to be moved to the left in a closed position under the tension of helical spring 88. In this position, fuel entering through opening 28 is prevented from moving through the nozzle 10.

It should be noted that in the off mode the chamber 150 has no vacuum in it and under those conditions needle valve 162 is urged by spring 180 to a closed position against channel 184. This prevents hydraulic fluid in the main cylinder 72 from flowing through passage 186 into accumulator cylinder 188.

Additionally, in this position, the turbine 16 and impeller 18 are motionless and there is no fluid in the spout 122. Furthermore, the sensing line passage 148 is open and at atmospheric pressure.

When the nozzle 10 is turned on, the unit assumes the dynamic position illustrated in FIGS. 4–5. In this position, the finger lever 40 is in an up position. This causes the trigger plunger 20 to move upwardly forcing the hydraulic fluid from the top of the plunger cylinder 50 through passage 68 and into the main cylinder 72. The increased volume of hydraulic fluid in the main cylinder 72 forces the poppet plunger 74 outwardly of the plunger cylinder 50 or to the right. This in turn moves the main poppet body 86 against the tension of helical spring 88 opening a passage between the main popper body 86 and the inner wall of the hand grip section 20. The fuel moves forwardly through the passage of opening 28 and past the venturi body 98. As the fuel moves forwardly past the venturi body 98 it lowers the pressure in the passage 102 which, through various lines and passages, is connected with opening 146. At this point, the opening 146 is presumably above the level of the fuel tank and therefore the decrease in pressure caused by the movement of fuel over the venturi body 98 does not result in a vacuum since air moves in through the opening 146.

The fuel moves forwardly through the unit into inlet passage 106 through elongated passage 100 and is directed onto the vanes 108 of the turbine sleeve 110 causing the turbine 16 to rotate. The fuel continues through the opening 128 and downwardly through the spout along the path generally shown at 30 and outwardly through the forward exit end 32.

As the fuel moves through the spout 122, the rotation of the turbine 16 simultaneously rotates the impeller vanes 130 of the impeller 18. The rotation of the impeller vanes 130 creates a suction in the vapor passage 140 drawing vapor inwardly through the vapor intake 142. Vapor is thus drawn through the vapor passage 140 upwardly through the spout 122 and through the pressurized impeller chamber 136 into a vapor conduit 24 rearwardly of the nozzle 10 and outwardly through the rear exit end 38 into a suitably connected tubular conduit.

As the nozzle 10 remains open, fuel continues to pump through the nozzle 10 into a tank. When the tank becomes filled and the fuel in the tank reaches the level of the spout 122, it will ultimately rise above the level of opening 146. When the fuel rises above the level of opening 146, a further dynamic change in the operation of the nozzle 10 takes place.

At this point, the closure of opening 146 causes a vacuum to form in venturi passage 102 with which the opening 146 is in fluid communication. When a vacuum is formed in the venturi passage 102, the unit assumes the position best illustrated in FIGS. 6 and 7. In this arrangement, the vacuum reduces the pressure in chamber 150. The reduction of pressure in chamber 150 causes the needle valve 162 to move to the right against the tension of spring 180. The use of the second diaphragm 166 results in lower friction which permits easier reciprocating movement of the needle valve 162. This low friction is a useful feature of the invention since it permits the use of a smaller needle valve assembly. It also permits a slow closing eliminating hydraulic shock which occurs in automatic shut-off systems of this general type.

When the needle valve 162 moves out of engagement with the channel 184, hydraulic fluid then passes through the channel 184 from the main cylinder 72. Fluid moving from the main cylinder 72 into the needle valve cylinder 164 and then through passage 186 into the accumulator cylinder 188. In this mode, the hydraulic fluid moving into the accumulator cylinder 188 permits the movement of the poppet plunger 74 to the left under the tension of spring 88 which forces the poppet body 86 to the left. On movement of the poppet body 86 to the left, as viewed in FIG. 6, the fuel is shut off by closure of the popper body 86 against the venturi body 98.

At the same time, the check valve 94, which is no longer pushed to the left by the force of the fuel, moves to the right under the tension of a spring 96.

On closure of the main poppet body 86, the fuel is shut off thus ultimately causing the turbine vanes 108 to cease rotation and similarly the impeller vanes 130 to cease rotation stopping the suction of vapor from the tank.

As the spout 122 is withdrawn from the fuel tank, the vacuum formed by the closure of opening 146 is removed. This in turn causes the vacuum in chamber 150 to return to ambient atmospheric levels. In turn, the spring 180 forces the needle valve 162 to the closure position of the off mode. However, before this occurs, the tension of spring 192 in the accumulator cylinder 188 forces the accumulator plunger 190 to the left as illustrated in FIG. 7. This in turn forces the hydraulic fluid in the accumulator cylinder 188 back through the passage 186 and through the needle valve cylinder 164 and channel 184 into the main cylinder 72.

It should be understood that various changes and modifications and equivalents of the embodiment described and shown in the drawings may be made within the scope of this invention. Thus, it is intended that all matters contained in the above description or shown in the accompanying drawings shall be interpreted in an illustrative and not limiting sense. Furthermore, the vapor recovery nozzle should not be limited to use with fuel tanks for automobiles as described. For example, the complete system may be used in conjunction with the pumping of acids or other fluids between any type of tank or container.

What is claimed is:

1. An automatic shut off system for a nozzle comprising:

means for generating a vacuum;

a hydraulic fluid containing main cylinder;

a hydraulic fluid containing accumulator cylinder;

a passage means for operatively interconnecting said main cylinder and said accumulator cylinder;

needle means normally closing said passage to prevent the hydraulic fluid from passing into said accumulator cylinder from said main cylinder; and means for moving said needle means from closing arrangement in said passage upon generation of a vacuum by said vacuum generating means.

2. An automatic shut off system as set forth in claim 1 wherein said needle means comprises a needle valve having a diameter at least the diameter of said passage means.

3. An automatic shut off system as set forth in claim 2 further comprising a first diaphragm engaging said needle valve for movement of said needle valve from closing engagement in said passage upon generation of a vacuum.

4. An automatic shut off system as set forth in claim 3 further comprising a second diaphragm, parallel and secured to said first diaphragm and wherein said second diaphragm is secured to said needle valve.

5. In a fuel delivery vapor recovery nozzle means for controlling the flow of fuel in one direction and vapor in a second direction through said nozzle, the improvement comprising:

a hydraulic system within said nozzle operatively connected to a fuel passage closing valve means, and a vacuum system within said nozzle, and a needle valve operatively connected to said vacuum system for controlling said hydraulic system.

6. The improvement as set forth in claim 5, wherein the hydraulic system includes a plurality of hydraulic cylinders each having a plunger, with one of said plungers longitudinally movable in response to hydraulic pressure for operatively engaging said fuel passage closing valve means.

7. The improvement as set forth in claim 6, wherein said vacuum system includes a venturi passage connected by a network of passages to the delivery end of said nozzle.

* * * * *